US007851429B2

(12) United States Patent
Wright et al.

(10) Patent No.: US 7,851,429 B2
(45) Date of Patent: Dec. 14, 2010

(54) RECAPTURE OF IONS APPLIED IN A WASH PROCESS

(75) Inventors: Tremitchell Wright, Elkhart, IN (US); Zaki Yusuf, Stevensville, MI (US); Joel Adam Luckman, Benton Harbor, MI (US); Robert D. Riehle, Raleigh, NC (US)

(73) Assignee: Whirlpool Corporation, Benton Harbor, MI (US)

( * ) Notice: Subject to any disclaimer, the term of this patent is extended or adjusted under 35 U.S.C. 154(b) by 822 days.

(21) Appl. No.: 11/745,039

(22) Filed: May 7, 2007

(65) Prior Publication Data

US 2008/0276962 A1 Nov. 13, 2008

(51) Int. Cl.
*C11D 3/39* (2006.01)

(52) U.S. Cl. ..... 510/376; 510/311; 8/111; 8/137

(58) Field of Classification Search ..... 510/311, 510/376; 8/111, 137
See application file for complete search history.

(56) References Cited

U.S. PATENT DOCUMENTS 3,772,901 A 11/1973 Ferraro
4,033,868 A 7/1977 Meichsner et al.
4,255,148 A 3/1981 Reinwald et al.
4,274,962 A 6/1981 Queiser et al.
2003/0056298 A1 3/2003 Hirsch et al.
2003/0189002 A1 10/2003 Proulx et al.
2003/0213503 A1 11/2003 Price et al.
2003/0226214 A1 12/2003 Radomyselski et al.
2005/0056581 A1 3/2005 Arguello
2005/0155393 A1 7/2005 Wright et al.
2005/0224099 A1 * 10/2005 Luckman et al. ..... 134/41

FOREIGN PATENT DOCUMENTS

EP 0002423 A1 6/1979
GB 2348117 A 9/2000

* cited by examiner

*Primary Examiner*—Gregory E Webb
(74) *Attorney, Agent, or Firm*—Clifton G. Green; Greer, Burns & Crain Ltd

(57) ABSTRACT

A wash cycle is provided for a clothes washer, the clothes washer having a wash zone for receiving a substrate load to be cleaned. The wash cycle includes a step of providing a wash liquor for applying to the substrate load. Another step is loading the wash zone with the substrate load. Another step is mixing metal ions with an inactive bleaching agent as catalyst agents to catalyze an activation reaction to produce an active bleaching agent. Another step is combining the active bleaching agent with the wash liquor. Another step is applying the wash liquor with the active bleaching agent to the substrate load. Another step is capturing the metal ions prior to a disposal of the wash liquor.

20 Claims, 3 Drawing Sheets

RECAPTURE OF IONS APPLIED IN A WASH PROCESS

BACKGROUND OF THE INVENTION

In the washing of fabrics and other substrates, such as dishware, it is known to use bleaching agents to remove different types of stains. The bleaching agents may be combined with the detergent chemistries, such as being already combined in the detergent liquid or powder sold to the appliance user. In such situations, the bleaching agent is incorporated into the wash liquor at the same time as other cleaning chemistries, such as enzymes, and the two types of chemistries may counteract or lessen the effectiveness of the other, thereby reducing the potential cleaning ability of the detergent.

Further, bleaching agents may not be stable over long periods of time, particularly if the bleaching agent is in an active state or condition. This then either requires that the bleaching agent be provided in a stable, but inactive condition, in which it is less effective in providing a bleaching or oxidizing action, or requires that the bleaching agent be used promptly after its formulation, reducing the effective shelf life of the detergent.

It is known to activate bleaching agents with metal ions which catalyze an activation reaction to produce an active bleaching agent. The use of these ions in a wash system, however, could potentially cause environmental concerns if allowed to pass into the waste water system.

When the inactive bleaching agent and the metal ions are provided simultaneously with the detergent, such as by being provided in a power form so that the bleaching agent remains stable, the user loses control over when the bleaching action occurs during the wash cycle, and is unable to selectively activate the bleaching agent when desired in the wash cycle.

SUMMARY OF THE INVENTION

In an embodiment of the invention, a wash cycle is provided for a washing machine, such as a clothes washer or a dishwasher, the washer having a wash zone for receiving a load of fabric or other substrates to be cleaned, such as dishware. The wash cycle includes a step of providing a wash liquor for applying to a substrate load. Another step is loading a wash zone with a substrate load. Another step is mixing metal ions with an inactive bleaching agent as catalyst agents to catalyze an activation reaction to produce an active bleaching agent. Another step is combining the active bleaching agent with the wash liquor. Another step is applying the wash liquor with the active bleaching agent to the substrate load. Another step is capturing the metal ions prior to a disposal of the wash liquor.

In an embodiment, the inactive bleaching agent is selected from the group consisting of peroxides including perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, peroxy acids, organic peroxides and mixtures of such peroxides.

In an embodiment, the metal ions are selected from the group consisting of transition metals and transition metal organic compounds.

In an embodiment, the step of dispensing the metal ions comprises forming an electrode with a transition metal and running a current through the electrode while the electrode is in contact with the wash liquor.

In an embodiment, the step of dispensing the metal ions comprises providing a solid block of material containing the metal ions, or salts thereof, and subjecting the block to a flow of wash liquor thereover.

In an embodiment, the step of dispensing the metal ions comprises dispensing a liquid solution containing the metal ions into the wash liquor.

In an embodiment, the step of dispensing metal ions into the wash liquor comprises releasing previously captured ions into the wash liquor.

In an embodiment, the step of dispensing metal ions comprises operating an electrolysis system with an electric current flowing in a first direction and the step of capturing the metal ions comprises operating the electrolysis system with the electric current flowing in an opposite direction.

In an embodiment, the step of capturing the metal ions comprises capturing the metal ions in a disposable cartridge.

In an embodiment, the step of capturing the metal ions in the disposable cartridge comprises using an ion exchange resin.

In an embodiment, the step of capturing the metal ions in the disposable cartridge comprises using a molecular sieve.

In an embodiment, the wash cycle includes a step of activating a user perceptible indicator to signal when the cartridge requires replacement.

In an embodiment, the step of capturing the ions comprises dispensing a compound to the wash liquor to one of precipitate and sequester the ions.

In an embodiment, the step of capturing the precipitated or sequestered ions occurs via filtering the wash liquor.

In an embodiment, the compound dispensed to precipitate the ions comprises a flocculent.

In an embodiment, the step of capturing the ions comprises exposing the wash liquor containing the metal ions to a material which selectively absorbs the ions.

In an embodiment of the invention, a wash cycle is provided for a clothes washer, the clothes washer having a wash zone for receiving a substrate load to be cleaned. The wash cycle includes a step of applying a wash liquor to a substrate load. Another step is introducing an inactive bleaching agent into the wash liquor. Another step is, at a desired time in the wash cycle, subsequent to the introduction of the inactive bleaching agent into the wash liquor, dispensing metal ions into the wash liquor as catalyst agents to catalyze an activation reaction to produce an active bleaching agent. Another step is capturing the metal ions prior to a disposal of the wash liquor.

In an embodiment, the step of introducing the inactive bleaching agent occurs simultaneously with the introduction of a detergent into the wash liquor.

In an embodiment, the step of introducing the inactive bleaching agent into the wash liquor occurs independently of introducing a detergent into the wash liquor.

In an embodiment of the invention, a wash cycle is provided for a clothes washer, the clothes washer having a wash zone for receiving a substrate load to be cleaned. The wash cycle includes a step of, subsequent to the beginning of the wash cycle, mixing metal ions with an inactive bleaching agent as catalyst agents to catalyze an activation reaction to produce an active bleaching agent. Another step is combining the active bleaching agent with a wash liquor. Another step is applying the wash liquor with the active bleaching agent to a substrate load. Another step is capturing the metal ions prior to a disposal of the wash liquor.

DETAILED DESCRIPTION OF THE PREFERRED EMBODIMENTS

Figure 1:
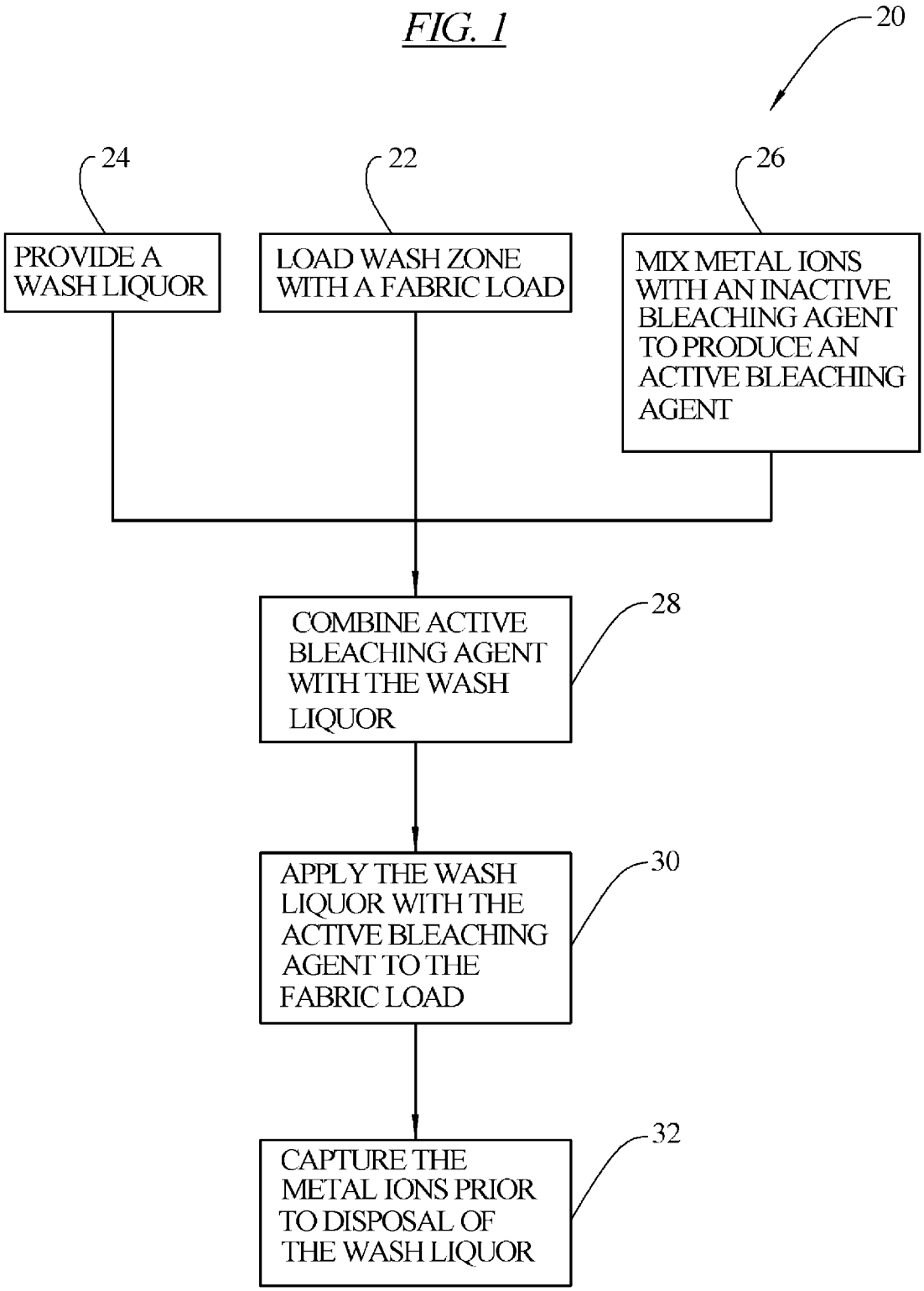
FIG. 1 is a flow chart diagram of a wash cycle embodying the principles of the present invention.

In an embodiment of the invention, as shown in FIG. 1, a wash cycle 20 is provided comprising a plurality of steps.

Figure 2:
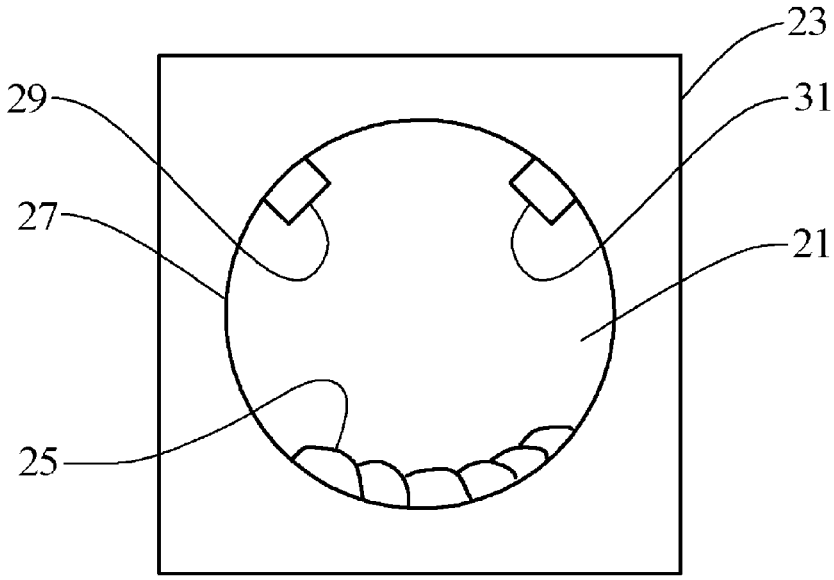
FIG. 2 is a schematic illustration of a wash machine with a wash zone.

A step 22 includes loading a wash zone 21 (FIG. 2) of a wash machine 23 with a substrate load 25 for cleaning. The wash zone 21 may be located in a rotatable drum 27 of a horizontal axis washer or a vertical axis washer. Other types of washer constructions could be used as well including a dishwasher. A particular embodiment of the invention is described herein, referring sometimes specifically to a clothes washer, however the invention is not limited to wash cycles only for clothes or other fabrics, but can be used on many different substrates to be cleaned, including dishware.

The wash cycle 20 includes a step 24 of providing a wash liquor. The wash liquor generally is a fluid, and may be a liquid, a gas, a vapor, a foam, or some combination of these states. During the wash cycle 20, the chemical composition of the wash liquor may change due to different additives being supplied to the wash liquor at different times, as well as portions of the wash liquor being discharged during the wash cycle, and being replaced with a different wash liquor. The wash liquor may have various chemistries therein, such as detergents, and additives or detergent chemistries including surfactants, emulsifiers, enzyme activated stain removers, sudsing agents, builders, anti-redeposition polymers and perfumes, and may be an aqueous or non-aqueous solution or mixture. The wash liquor may be applied to the substrate load 25 in the wash zone 21, such as by spraying through a spray nozzle 29.

Another step 26 of the wash cycle 20 is mixing metal ions with an inactive bleaching agent as catalyst agents to catalyze an activation reaction to produce an active bleaching agent. The inactive bleaching agent may be an additive that has already been added to the wash liquor, in which case, the metal ions may be dispensed directly into the wash liquor, to there mix with the inactive bleaching agent and catalyze the activation reaction. In an embodiment, introducing the inactive bleaching agent to the wash liquor occurs simultaneously with the introduction of a detergent into the wash liquor, such as by being included in the detergent solution or mixture. In another embodiment, introducing the inactive bleaching agent into the wash liquor occurs independently of introducing a detergent into the wash liquor.

In an alternate embodiment of step 26, the metal ions may be added to the inactive bleaching agent prior to dispensing the inactive bleaching agent into the wash liquor. If this latter approach is followed, the bleaching agent dispensed into the wash liquor will be an active bleaching agent. In this embodiment, the metal ions may be added to the inactive bleaching agent prior to the beginning of the wash cycle 30, or as an initial step in the wash cycle, or this step 26 may occur subsequent to the beginning of the wash cycle, while other steps are being performed, such as an initial washing step in a detergent based wash liquor with enzymes.

In this document, the term "inactive bleaching agent" is meant to mean a bleaching agent that, while not entirely inert, it is relatively slow acting, at least as compared to when it become an "active bleaching agent" after the catalyst reaction with the metal ions, such that when it is an "active bleaching agent" it is at least about twice as active, by having at least about twice as many free radicals, as when it is an "inactive bleaching agent."

In an embodiment, the inactive bleaching agent may be one or more of peroxides including perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, peroxy acids, organic peroxides and mixtures of such peroxides. The bleaching agent may be provided in a solid form, such as a powder, or in a liquid or gaseous solution or mixture.

In an embodiment, the metal ions may be from one or more transition metals and transition metal organic compounds.

The first three steps, loading substrates into the wash zone step 22, providing a wash liquor 24 and mixing metal ions with an inactive bleaching agent 26 may occur in different orders and at different times, or simultaneously.

At a desired point in the wash cycle 20 there is a step 28 of combining the active bleaching agent with the wash liquor. This could occur after the step 26 of mixing the metal ions with the inactive bleaching agent, if that inactive bleaching agent has not already been supplied to the wash liquor. The step 28 of combining could occur simultaneously with the step 26 of mixing if the inactive bleaching agent is already present in the wash liquor, or is being supplied to the wash liquor while the metal ions are being supplied.

The inactive bleaching agent may be dispensed into the wash liquor that has already been applied to the substrate load 25, or the bleaching agent may be dispensed into the wash liquor prior to the wash liquor being applied to the substrate load. The bleaching agent may be included with other chemistries, such as detergents, and additives or detergent chemistries including surfactants, emulsifiers, enzyme activated stain removers, sudsing agents, builders, anti-redeposition polymers and perfumes, and may be an aqueous or non-aqueous solution or mixture that are added to the wash liquor, or the bleaching agent may be added separately from other chemistries such as via a separate spray nozzle 31 if provided in a fluid state.

Another step 30 is to apply the wash liquor with the active bleaching agent to the substrate load 25. This wash liquor may be applied to the substrate load 25, such as by spraying the wash liquor against the substrate load in the wash zone 21, filling the wash zone with the wash liquor before introduction of the substrate load, introducing the wash liquor to a wash tub and from there allowing the wash liquor to flow into a perforate wash basket defining the wash zone, or any other method of applying a wash liquor to a substrate load, as is known in the art.

Figure 3:
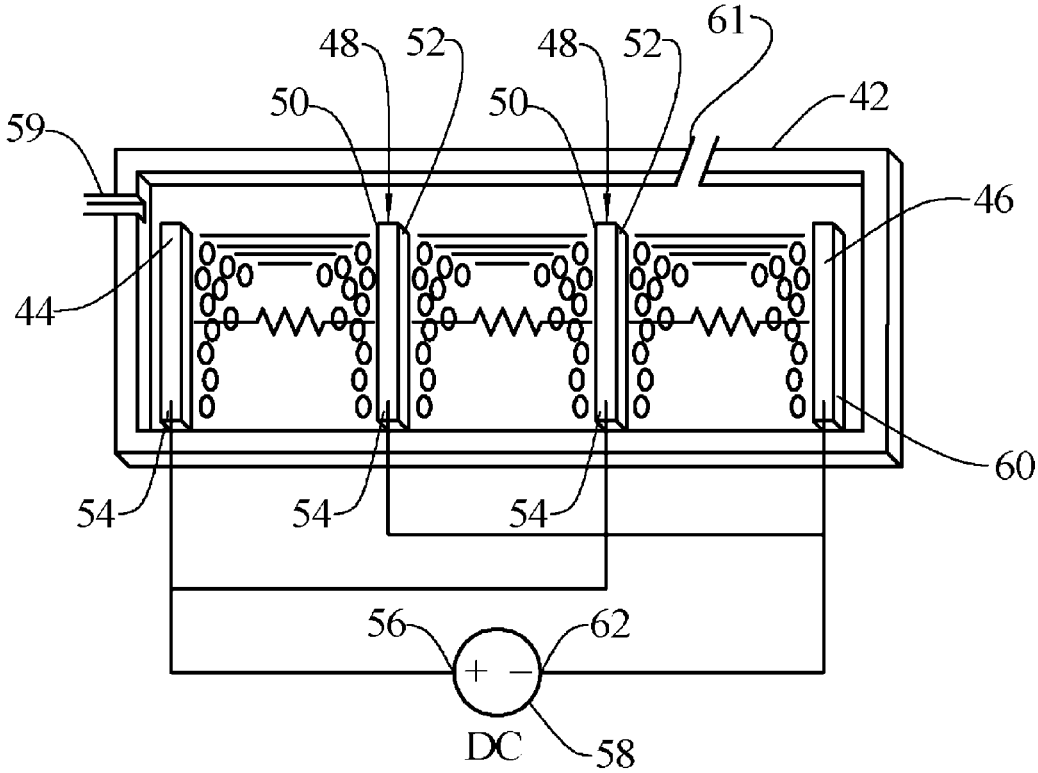
FIG. 3 is a schematic illustration of a metal ion generator.

In an embodiment, the step 26 of mixing the metal ions includes dispensing the metal ions with an electrolysis apparatus 42 (FIG. 3) having a first metallic plate 44, and perhaps a last metallic plate 46 and a plurality of intermediate metallic plates 48. Each of the plates 44, 46, 48 are formed of, or coated with a transition metal. For example, the plates 44, 46, 48 may have a support or substrate made of a material such as plastic, or some other non-transition metal material, with a surface coating of the transition metal material.

The plates 44, 46 and 48 have two essentially parallel sides 50, 52 with a large surface area in comparison with a peripheral side 54 connecting the parallel sides 50, 52. The plurality of plates 44, 46, 48 are arranged with one of the parallel sides 50, 52 of one plate facing one of the parallel sides 50, 52 of an adjacent plate, for each of the plurality of intermediate plates. In some embodiments, the plates may be arranged in a straight row such that facing sides 50, 52 would be arranged in a parallel manner, while in other embodiments, the plates 44, 46, 48 may be arranged in an arcuate manner, in which the facing sides 50, 52 would be arranged at an angle to each other, which typically would be less than 45 degrees.

A connection 54 is provided between a positive electrode 56 of a source 58 of direct electrical current and the first plate 44 and a connection 60 is provided between a negative electrode 62 of the source 58 of direct electrical current and the last plate 46. The wash liquor could be directed to flow through the electrolysis apparatus from an inlet 59 to an outlet 61 to pick up metal ions from the plates 44, 46, 48 to distribute them throughout the wash liquor. Other configurations for the electrolysis apparatus 42 and the electrical current supply are described in published U.S. Patent Application US1005/0224339, which is incorporated herein by reference.

Figure 4:
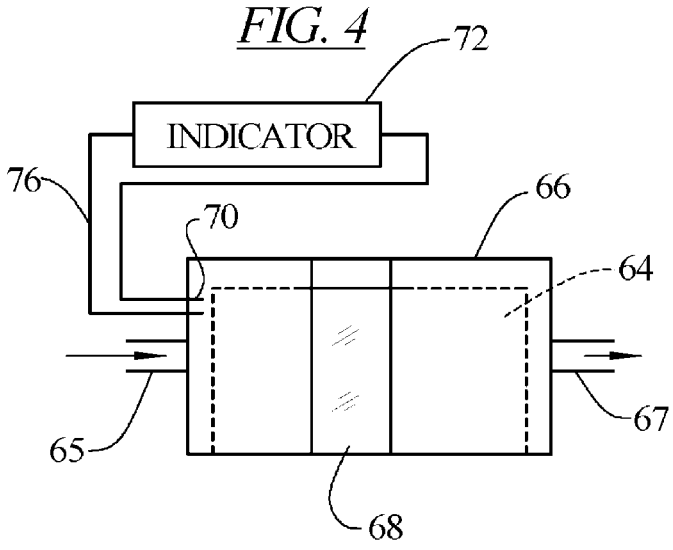
FIG. 4 is a schematic illustration of a metal ion dispenser.

In an embodiment, the step 26 of mixing the metal ions comprises providing a solid block of material 64 (FIG. 4) containing the metal ions, or salts thereof, and subjecting the block to a flow of wash liquor thereover. The block of material 64 could be located in a separate container 66 with a flow of wash liquor directed through the container from an inlet 65 to an outlet 67 at selected times during the wash cycle 20. The block of material 64 would slowly erode as the wash liquor flows over it, distributing the metal ions throughout the wash liquor.

Various types of indicators could be utilized to alert the appliance user when the container 66 requires recharging with additional material or replacement. For example, the container 66 could be at least partially clear, as at 68, so that the contents 64 of the container are visible from the exterior. Alternatively, sensors 70 could be provided in the container 66 to detect the presence or absence of the material 64 and to operate a visual or audible indicator 72 (electrical or mechanical) when the material has been consumed. For example, lamps, LEDs or other electrically operated indicators 72 providing visual signals could be utilized. Alternatively, indicators 72 such as buzzers or other audible devices could be utilized. Protruding flags, turning colored wheels, or similar mechanical indicators 72 could be utilized. In other arrangements, timers operated by the operation of the appliance, or wash cycle counters could be used to change the state of the indicator 72. In still other arrangements, dissolvable components could be used that would dissolve over a known period of time in the presence of a wash liquor, to release a spring biasing force used to display the indicator 72, or to close a circuit to an electrical indicator. The sensors 70 could also be connected to a network 76 within the home, such as a local area computer network or a house appliance control network, or a larger network, such as the internet, to send a signal to another device to alert the user that the container requires recharging, to order a new container, or to order a service call to refill the container.

Figure 5:
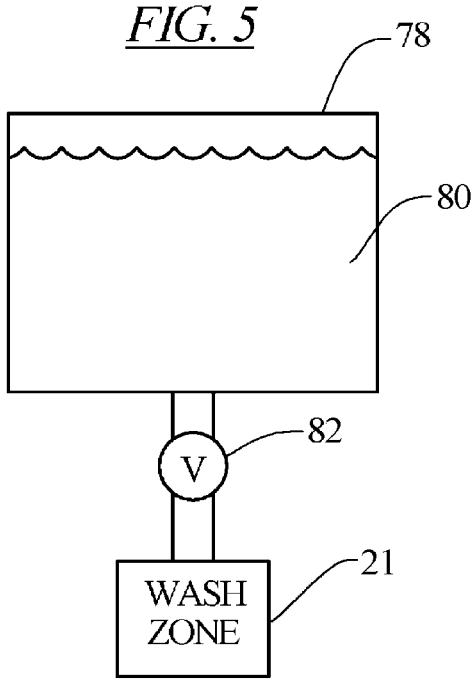
FIG. 5 is a schematic illustration of a metal ion dispenser.

In an embodiment, the step 26 of mixing the metal ions comprises dispensing a fluid solution or mixture containing the metal ions into the wash liquor. Again, a separate container 78 (FIG. 5) may be provided with a fluid 80 therein including the metal ions. At selected portions of the wash cycle, a desired amount of the fluid can be discharged from the container 78 into the wash liquor, such as by activation of a valve 82, to distribute the metal ions throughout the wash liquor. Again, various types of indicators, as described above, could be utilized to alert the appliance user when the container 78 requires recharging with additional fluid material 80, or when the container needs to be replaced with a new, filled container.

Another step 32 of the wash cycle 20 is capturing the metal ions prior to a disposal of the wash liquor. Typically this would occur either while the wash liquor is being drained from the appliance, or during the wash cycle, prior to the step of draining the wash liquor.

In an embodiment of the wash cycle 20, particularly where the step 26 of mixing metal ions with the inactive bleaching agent comprises operating an electrolysis system 42 with an electric current flowing in a first direction, the step 32 of capturing the metal ions could comprise operating the electrolysis system with the electric current flowing in an opposite direction so that the metal ions would be redeposited onto the plates 44, 46, 48.

Figure 6:
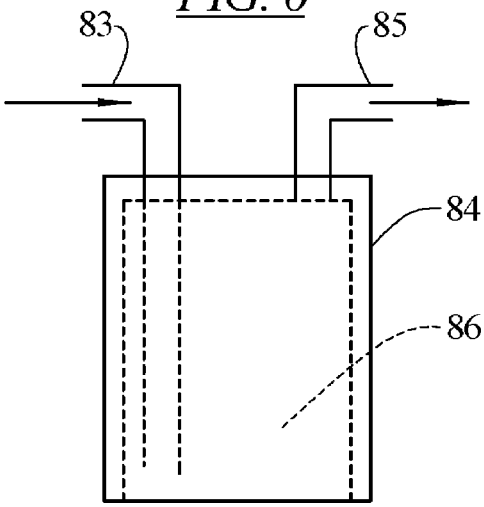
FIG. 6 is a schematic illustration of a metal ion filter cartridge.

In another embodiment of the wash cycle, the step 32 of capturing the metal ions comprises capturing the metal ions in a disposable cartridge 84 (FIG. 6) having an inlet 83 and an outlet 85. The washer appliance may be provided with a separate particle filter for capturing various sized particles, such as dirt or foreign objects, in addition to a chemical filter 86 such as contained in the disposable cartridge 84 for capturing the metal ions. This cartridge 84 could be located in a readily accessible portion of the wash appliance 23, or exterior of the appliance cabinet, so that the cartridge could be removed and replaced when it had reached its capacity for capturing metal ions. As described above, various types of indicators could be utilized to alert the appliance user when the cartridge 84 requires replacement.

In an embodiment, the step 32 of capturing the metal ions in the disposable cartridge 84 comprises using an ion exchange resin in the cartridge. In an embodiment, the step 32 of capturing the metal ions in the disposable cartridge 84 comprises using a molecular sieve in the cartridge.

In an embodiment, the step 32 of capturing the ions comprises dispensing a compound to the wash liquor to one of precipitate and sequester the ions. For example, a flocculent or a chelate could be used to precipitate or sequester the ions. Depending on the compound being used, the precipitated or sequestered ions may be rendered harmless, and might be able to be discharged with the remainder of the wash liquor. As described above, a separate container with the compound therein could be used, with an appropriate indicator to notify the user when the container required refilling or replacement is needed. With certain compounds, it may be necessary or desirable to capture the precipitated or sequestered ions via filtering the wash liquor with a typical particle filter, via a centrifugal separator, via a quiet zone settling tank, through electrophoresis, or similar known arrangements for removal of solids from fluids.

In an embodiment, the step 32 of capturing the ions comprises exposing the wash liquor containing the metal ions to a material which selectively absorbs the ions. This material may be held in a replaceable cartridge, with appropriate indicator to notify the user when the cartridge needs to be replaced.

In an embodiment, the step 26 of mixing metal ions with an inactive bleaching agent comprises releasing previously captured ions into the wash liquor. This could be accomplished through reverse flow of wash liquor through an area where the metal ions have been captured, or if electrolysis is being used, reversing the direction of current flow through the plates 44, 46, 48.

In another embodiment, the step 32 of capturing the ions includes multiple steps wherein a portion of the ions are captured by one method, such as by precipitation or sequestration, while another portion of the ions are captured by another method, such as via an ion resin exchange, thereby lengthening the service life of the disposable cartridge 84.

Various features and steps of the wash cycle have been described which may be incorporated singly or in various combinations into a desired wash cycle, even though only certain combinations are described herein. The described combinations should not be viewed in a limiting way, but only as illustrative examples of particular possible combinations of features.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of washing clothes in a clothes washer, the clothes washer having a wash zone for receiving a substrate load to be cleaned, comprising the steps:

providing a wash liquor for applying to the substrate load, loading the wash zone with the substrate load, providing an inactive bleaching agent in the wash liquor, thereafter, mixing metal ions with the inactive bleaching agent in the wash liquor to produce an active bleaching agent in the wash liquor, applying the wash liquor with the active bleaching agent to the substrate load, and capturing the metal ions prior to a disposal of the wash liquor.

2. The method according to claim 1, wherein the inactive bleaching agent is selected from the group consisting of peroxides including perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, peroxy acids, organic peroxides and mixtures of such peroxides.

3. The method according to claim 1, wherein the metal ions are selected from the group consisting of transition metals and transition metal organic compounds.

4. The method according to claim 1, wherein the bleaching agent is introduced to the wash liquor in an inactive state and the step of mixing the metal ions comprises forming an electrode with a transition metal and running a current through the electrode while the electrode is in contact with the wash liquor.

5. A method of washing clothes in a clothes washer, the clothes washer having a wash zone for receiving a substrate load to be cleaned, comprising the steps:

providing a wash liquor for applying to the substrate load, loading the wash zone with the substrate load, mixing metal ions with an inactive bleaching agent to produce an active bleaching agent, applying the wash liquor with the active bleaching agent to the substrate load, and capturing the metal ions prior to a disposal of the wash liquor, wherein the bleaching agent is introduced to the wash liquor in an inactive state and the step of mixing the metal ions comprises providing a solid block of material containing the metal ions, or salts thereof, and subjecting the block to a flow of wash liquor thereover.

6. The method according to claim 1, wherein the bleaching agent is introduced to the wash liquor in an inactive state and the step of dispensing the metal ions comprises dispensing a liquid solution containing the metal ions into the wash liquor.

7. The method according to claim 1, wherein the step of mixing metal ions with the inactive bleaching agent comprises releasing previously captured ions into the wash liquor.

8. A method of washing clothes in a clothes washer, the clothes washer having a wash zone for receiving a substrate load to be cleaned, comprising the steps:

providing a wash liquor for applying to the substrate load, loading the wash zone with the substrate load, mixing metal ions with an inactive bleaching agent to produce an active bleaching agent, applying the wash liquor with the active bleaching agent to the substrate load, and capturing the metal ions prior to a disposal of the wash liquor, wherein the step of mixing the metal ions comprises operating an electrolysis system with an electric current flowing in a first direction and the step of capturing the metal ions comprises operating the electrolysis system with the electric current flowing in an opposite direction.

9. A method of washing clothes in a clothes washer, the clothes washer having a wash zone for receiving a substrate load to be cleaned, comprising the steps:

providing a wash liquor for applying to the substrate load, loading the wash zone with the substrate load, mixing metal ions with an inactive bleaching agent to produce an active bleaching agent, applying the wash liquor with the active bleaching agent to the substrate load, and capturing the metal ions prior to a disposal of the wash liquor, wherein the step of capturing the metal ions comprises capturing the metal ions in a disposable cartridge.

10. The method according to claim 9, wherein the step of capturing the metal ions in the disposable cartridge comprises using an ion exchange resin.

11. The method according to claim 9, wherein the step of capturing the metal ions in the disposable cartridge comprises using a molecular sieve.

12. The method according to claim 9, including a step of activating a user perceptible indicator to signal when the cartridge requires replacement.

13. The method according to claim 1, wherein the step of capturing the ions comprises dispensing a compound to the wash liquor to one of precipitate and sequester the ions.

14. The method according to claim 13, including the step of capturing the precipitated or sequestered ions via filtering the wash liquor.

15. A method of washing clothes in a clothes washer, the clothes washer having a wash zone for receiving a substrate load to be cleaned, comprising the steps:

providing a wash liquor for applying to the substrate load, loading the wash zone with the substrate load, mixing metal ions with an inactive bleaching agent to produce an active bleaching agent, applying the wash liquor with the active bleaching agent to the substrate load, and capturing the metal ions prior to a disposal of the wash liquor, wherein the step of capturing the ions comprises dispensing a compound to the wash liquor to precipitate the ions, wherein the compound dispensed to precipitate the ions comprises a flocculent.

16. The method according to claim 1, wherein the step of capturing the ions comprises exposing the wash liquor containing the metal ions to a material which selectively absorbs the ions.

17. A method for washing clothes in a clothes washer, the clothes washer having a wash zone for receiving a substrate load to be cleaned, comprising the steps:

applying a wash liquor to a substrate load, introducing an inactive bleaching agent into the wash liquor, at a desired time in the method for washing clothes, subsequent to the introduction of the inactive bleaching agent into the wash liquor, dispensing metal ions into the wash liquor as catalyst agents to catalyze an activation reaction to produce an active bleaching agent, and capturing the metal ions prior to a disposal of the wash liquor.

18. The method according to claim 17, wherein the step of introducing the inactive bleaching agent occurs simultaneously with the introduction of a detergent into the wash liquor.

19. The method according to claim 17, wherein the step of introducing the inactive bleaching agent into the wash liquor occurs independently of introducing a detergent into the wash liquor.

20. A method for washing clothes in a clothes washer, the clothes washer having a wash zone for receiving a substrate load to be cleaned, comprising the steps:

in a wash cycle, applying a wash liquor with an inactive bleaching agent to the substrate load in the wash zone, subsequent to the application of the wash liquor with the inactive bleaching agent to the substrate load, mixing metal ions with the inactive bleaching agent as catalyst agents to catalyze an activation reaction to produce an active bleaching agent, applying the wash liquor with the active bleaching agent to the substrate load in the wash zone, and capturing the metal ions prior to a disposal of the wash liquor.

* * * * *